United States Patent [19]

Okabe et al.

[11] 4,107,969

[45] Aug. 22, 1978

[54] HOT STRIP COILING MANDREL

[75] Inventors: Hiroshi Okabe; Noboru Hase, both of Sawara; Hitoshi Asai, Itako; Teruo Hiramatu, Kashima, all of Japan

[73] Assignee: Sumitomo Metal Industries, Ltd., Osaka, Japan

[21] Appl. No.: 793,355

[22] Filed: May 3, 1977

[30] Foreign Application Priority Data

| | | | |
|---|---|---|---|
| May 15, 1976 | [JP] | Japan | 51-55757 |
| May 15, 1976 | [JP] | Japan | 51-55758 |
| Sep. 28, 1976 | [JP] | Japan | 51-130094[U] |

[51] Int. Cl.[2] ..... B21C 47/30; B65H 75/24

[52] U.S. Cl. ..... 72/148; 242/72.1

[58] Field of Search ..... 72/147, 148; 242/72 R, 242/72.1, 73; 269/48.1

[56] References Cited

U.S. PATENT DOCUMENTS

| | | | |
|---|---|---|---|
| 2,920,837 | 1/1960 | Wingard | 242/72.1 |
| 3,085,763 | 4/1963 | Floyd | 242/72.1 |
| 3,086,728 | 4/1963 | Martt | 242/72.1 |
| 3,107,875 | 10/1963 | Gochenour et al. | 242/72.1 |
| 3,658,274 | 4/1972 | Adair | 242/72.1 |
| 3,820,736 | 6/1974 | Moor | 242/72.1 |
| 3,881,666 | 5/1975 | Greenhalgh | 242/72.1 |

*Primary Examiner*—E. M. Combs

[57] ABSTRACT

A hot strip coiling mandrel has a mechanism for engaging a plurality of equally circumferentially divided drum segments about a core shaft and for moving the core shaft or the drum segments relatively axially to thereby radially expand and collapse the drum defined by the segments. Top marks caused at the leading coil end of a hot strip by the use of such a mandrel are prevented by the provision of a buffer between the core shaft and each of the drum segments.

9 Claims, 12 Drawing Figures

HOT STRIP COILING MANDREL

BACKGROUND OF THE INVENTION

The present invention relates to a hot strip coiling mandrel capable of preventing top marks (indentations or impressions) caused at the leading end of the coil during coiling a relatively thick hot strip of, for example, steel.

In hot strip mill operation, the production of relatively thick strips such, for example, as steel plates having a thickness of 6 mm or more has recently been increasing. For coiling such a relatively thick strip, there is generally used a mandrel having as a coiling shaft an assembly of a core shaft and a plurality of drum segments circumferentially divided into, for example, four equal parts. While a mandrel of this type is capable of expanding and collapsing radially by adjusting the core shaft or the drum segments, it has a serious disadvantage in coiling a relatively thick strip that top marks (indentations or impressions) are caused in the portions of the strip overlapping the leading coil end fastened to the mandrel around three to five turns because of the difference in the thickness of the coiled strip since the cross section of the coil is maintained always nearly in a right circle, thereby making it necessary to scrap the leading end portion of the strip having a length of 5 m to 10 m.

In order to overcome this disadvantage it has been proposed to provide pressure rolls such as wrapper rolls or buffer means. However, this has not yet achieved satisfactory results.

In coiling a relatively thin strip, on the other hand, since there is no possibility of the occurrence of top marks, no buffer means is required. Rather, provision of a buffer means will cause slippage between the mandrel and the strip. Accordingly, in coiling such relatively thin strip using the mandrel provided with a buffer means, there must also be provided means for keeping the buffers from carrying out their buffer function.

SUMMARY OF THE INVENTION

A primary object of the present invention is to provide a mandrel capable of preventing occurrence of top marks in coiling a hot strip to thereby overcome the disadvantage of the heretofore used mandrels and to increase the yield of coil of relatively thick strip.

Another object of the present invention is to provide buffer means applicable to mandrel expanding and collapsing mechanisms of both the wedge type and the link type.

A further object of the present invention is to provide a mandrel for coiling a relatively thick hot strip, and yet which is also suitable for coiling a relatively thin hot strip.

In order to achieve these objects, the coiling mandrel according to the present invention is to constructed as to compensate for the protrusion of the coil due to the thickness of the leading coil end by partially recessing the coiling surface of the coiling mandrel at the desired portion and by holding each of the drum segments resiliently.

The hot strip coiling mandrel according to the present invention comprises a plurality of segments of a drum which is divided circumferentially into equal segments, a core shaft inserted coaxially into said drum, and a plurality of buffer means, one provided between the core shaft and each of the drum segments, so as to expand and collapse the drum formed by said segments radially by relative axial movement of the core shaft and the drum segments.

The mechanism for radially expanding and collapsing radially the drum segments has been heretofore provided in two types, namely the wedge type and the link type. The wedge type mechanism comprises a core shaft provided thereon with a plurality of circumferentially spaced lines of saw-tooth inclined faces extending longitudinally of the shaft, and a plurality of drum segments divided equally circumferentially of the drum and each provided on the inner surface thereof with a line of longitudinally extending saw-tooth engaging faces complementary to the saw-tooth inclined faces of the core shaft, so that the drum formed by said segments is radially expanded and collapsed by relative axial movement of the core shaft and the drum formed by the segments. The link type mechanism comprises a plurality of drum segments divided equally circumferentially of the drum, a core shaft disposed centrally in a cylindrical space within the drum formed by said segments, and a number of links connecting said each segment and said core shaft with a given distance therebetween, so that the drum formed by said segments is radially expanded and collapsed by axial movement of either the drum segments or the core shaft.

For applying the buffer means according to the present invention to the wedge type expanding and collapsing mechanism, the mandrel according to the present invention may have a construction wherein a recess is formed in a given angular direction in each inclined face of the core shaft or the drum segments in which a block of the buffer means is fitted and a resilient member is interposed between the bottom face of said recess and the block. The block may be divided into two pieces fittingly engageable with each other so that a resilient member is interposed therebetween.

For applying the buffer means according to the present invention to the link type expanding and collapsing mechanism, the mandrel according to the present invention may have a construction wherein a recess is formed in a position corresponding to the link attachment of the core shaft or of the drum segment, a block is fitted into said recess, an end of the link is pivotally attached to said block which is the link attachment of the core shaft side or of the drum segment side, and a resilient member is interposed between the bottom face of said recess and said block.

For making the mandrel according to the present invention useful for coiling of both thick and thin strips, a retainer ring may be fittingly mounted adjacent each of the two ends of the drum so as to prevent the drum formed by the segments from expanding in diameter and, in coiling a relatively thin strip, to keep the buffer means inoperable by retaining the drum at the largest expanded diameter.

BRIEF DESCRIPTION OF THE DRAWINGS

The invention will be better understood from the following description taken in connection with the accompanying drawings in which.

DESCRIPTION OF THE PREFERRED EMBODIMENTS

Figure 1:
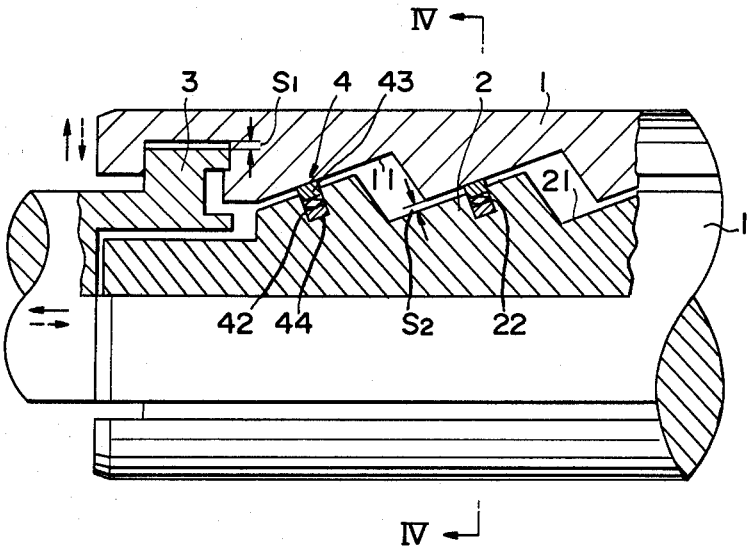
FIG. 1 is a partially broken away side view of buffer means according to the present invention applied, as an example, to a conventional wedge type mandrel.
Figure 2:
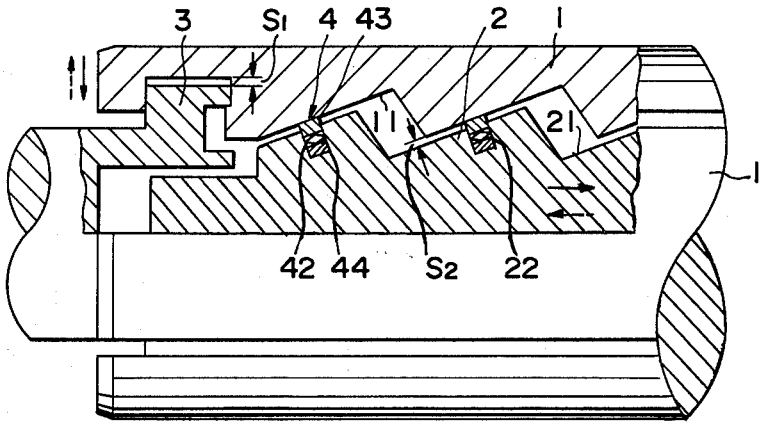
FIG. 2 is a view similar to FIG. 1 showing another mode of operation.
Figure 4:
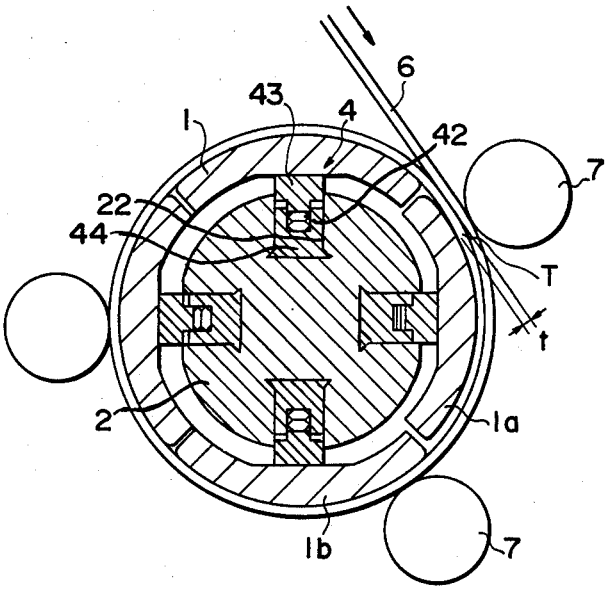
FIG. 4 is a cross-sectional view taken along the line IV—IV of FIG. 1.

Before describing embodiments of the present invention it will be better to outline an example of the mechanism for radially expanding and collapsing the conventional coiling mandrel. In the wedge type expanding and collapsing mechanism, as shown in FIGS. 1, 2, and 4, a drum is divided circumferentially into, for example, four segments 1 of the same configuration and a core shaft 2 of a different configuration is disposed coaxially with and extending through said drum formed by said four segments 1. On the inside surface of each drum segment 1 in contact with the core shaft 2 is provided with a series of axially extending saw-tooth like inclined faces 11. On the surface of the core shaft 2 in contact the drum segments 1 are provided with four lines of axially extending saw-tooth like inclined faces 21 which are complementary to the inclined faces 11 of the drum segments 1. The segments 1 are held at one axial end by shaft end locking means 3 and are movable radially over a given distance. The drum segments 1 are so constructed that when the core shaft 2 is moved axially relative to the segments, the four segments are moved radially the same distance simultaneously by the engagement between the inclined faces to thereby expand or collapse radially the drum, namely the mandrel. FIG. 1 shows the construction in which the core shaft 2 is stationary and the drum segments are movable axially so as to radially expand or collapse the drum. FIG. 2 shows the construction in which, contrary to that of FIG. 1, the drum segments 1 are stationary and the core shaft 2 is movable axially to expand or collapse the drum radially.

Figure 8:
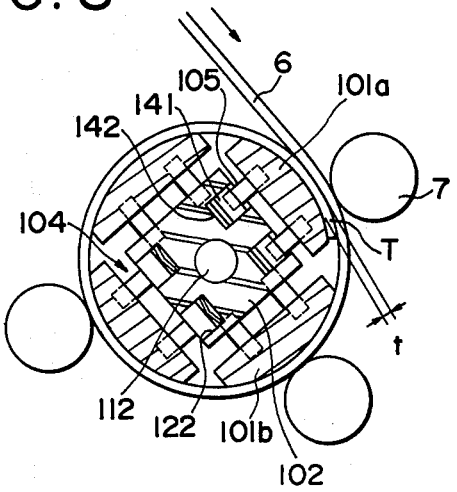
FIG. 8 is a cross-sectional view taken along the line VIII—VIII of FIG. 6.
Figure 6:
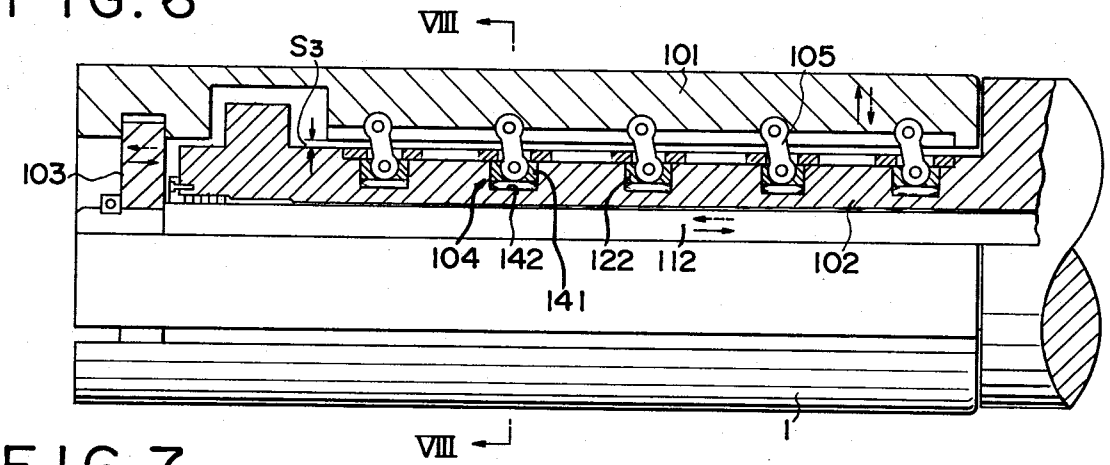
FIG. 6 is a partially broken away side view of the buffer means according to the present invention applied to a conventional link type mandrel.
Figure 7:
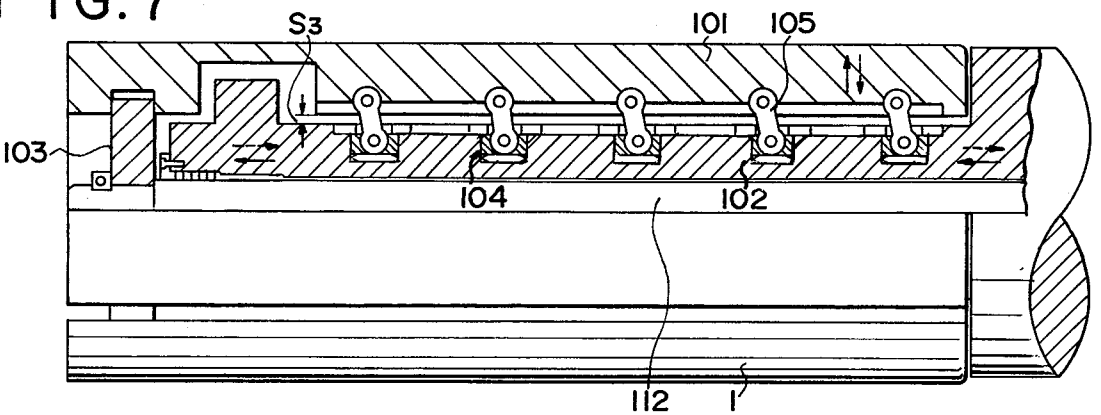
FIG. 7 is a view similar to FIG. 6 showing another mode of operation.

In the expanding and collapsing mechanism of the link type mandrel shown in FIGS. 6, 7 and 8, a drum is divided equally circumferentially into, for example, four segments 101 having the same configuration and a core shaft 102 having a different configuration extends through a space defined in the center of the drum. In the center of the core shaft 102 is provided a control shaft 112 extending therethrough. The control shaft 112 is connectable through a spider 103 mounted on an end thereof to said drum segments 101 so as to transmit the movement of the control shaft 112 to the segments 101. Each of the drum segments 101 is disposed parallel to the core shaft 102 at a predetermined space $S_3$ therefrom and is connected to the core shaft by a number of parallel links 105. When the core shaft 102 and the segments 101 are moved relatively axially by adjusting said core shaft 102 or said control shaft 112, the links 105 become uniformly inclined to expand or reduce said space $S_3$ to thereby radially expand or collapse the coiling drum formed by the four segments 101. FIG. 6 shows the construction in which the core shaft 102 is stationary, and the control shaft 112 and the segments 101 are axially movable to thereby radially expand and collapse the drum. FIG. 7 shows the construction in which, contrary to that of FIG. 6, the control shaft 112 and the segments 101 are stationary, and the core shaft 102 is axially movable to expand and collapse the drum radially.

The buffer means according to the present invention will now be described. In the wedge type mandrel, as shown in FIGS. 1, 2 and 4, the drum is divided into four equal segments 1, and each of the segments 1 is independently displaceable in the direction toward the axis, namely in the radial direction. In the mandrel according to the present invention, buffer means 4 are interposed between the inclined faces of the segments 1 and of the core shaft 2 engageable therewith and the buffer means 4 are constructed to hold the segments 1 resiliently. In the present invention, when it is desired to position the buffer means 4 normal to the respective inclined faces of the members in association therewith, each of the inclined faces 21 of, for example, the core shaft 2 is provided with a recess 22 extending normal thereto, and in which a pair of blocks 43 and 44 and resilient members such as plate springs 42 are disposed.

Figure 5:
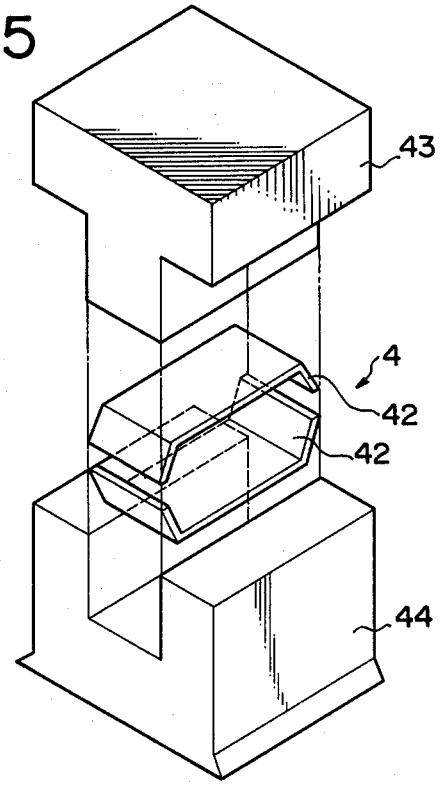
FIG. 5 is an exploded perspective view of an embodiment of the buffer means according to the present invention.

In each of the buffer means 4, as shown in an enlarged and exploded view in FIG. 5, the resilient members 42 such as the plate springs are mounted between a pair of the complementary blocks 43 and 44 to provide an appropriate buffer function.

A buffer space $S_1$ is formed radially between the shaft side locking means 3 and each drum segment 1. Accordingly, the block 43 projects perpendicularly from the inclined face 21 of the core shaft and engages flush with the inclined face 11 of the segment 1 so as to keep the segment 1 at a distance $S_2$. When a specific load is applied to the segment 1, the block 43 is depressed against the buffer function of the resilient member 42 into the recess 22 to thereby displace only the segment 1 to which said specific load is applied in the direction to reduce the outside diameter thereof.

While it is preferable in the present invention to provide the recesses 22 into which the blocks 43 and 44 of the buffer means 4 are inserted in the core shaft, the same effect is achieved when the recesses 22 are provided in the segments 1 so that the end faces of the blocks 44 abut and engage the inclined faces 21 of the core shaft.

Figure 3A:
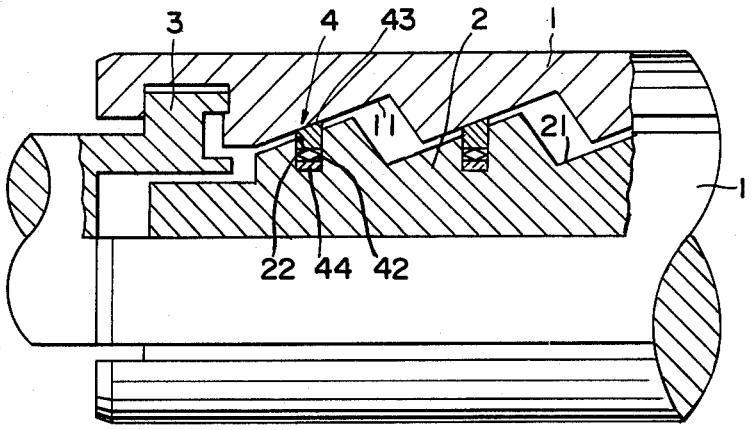
FIGS. 3A and 3B are views similar to FIG. 1 showing modifications of the buffer means.

When it is necessary to provide each recess 22 perpendicularly to the axial direction as shown in FIG. 3A, the recess 22 is provided at a predetermined angle to the inclined face of the core shaft 2 and the top of the upper block 43 is provided with an inclined face inclined at the predetermined angle.

Figure 3B:
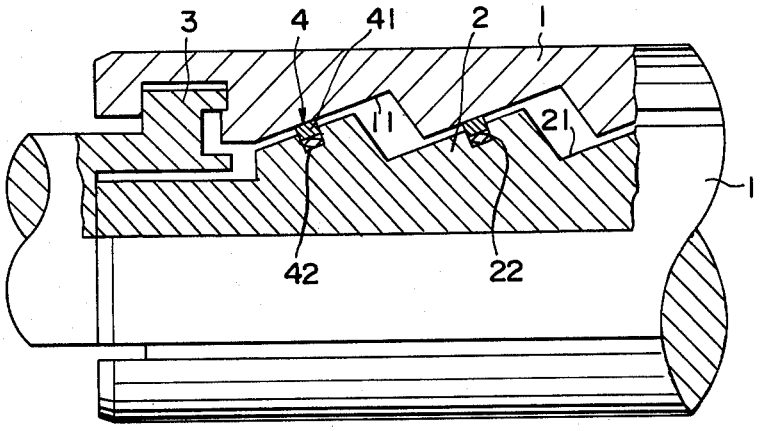

While the block has been described in the foregoing description as being provided in two pieces having complementary configurations, a single block 41 may be used as shown in FIG. 3B to simplify the construction. In the single block construction, the resilient member 42 is disposed directly on the bottom of the recess 22 in which the block 41 is placed.

In place of a resilient material such as the plate spring and rubber, a fluid mechanism may be used as a resilient member and be incorporated in the mandrel according to the present invention.

While this embodiment has been described hereinabove in relation to a mandrel with four segments, it is also applicable to mandrels with six or eight segments.

In the link type mandrel shown in FIGS. 6, 7 and 8, buffer means 104 is provided at each position at which an end of a link 105 is supported. Namely, instead of attaching said end of each link 105 directly to the core shaft, said end of each link 105 is pivotally attached to a block 141 fitted into a recess 122 in the core shaft 102. While each block 141 is slidably fitted into the recess 122, it is given a smaller thickness than the depth of the recess and a resilient member 142 such as a plate spring is provided between block 141 and the bottom face of the recess 122 to provide a buffer function.

While it is preferable from the viewpoint of structural strength to provide the buffer means 104 in the core shaft as in this embodiment, the same effect can theoretically be achieved even when the buffer means 104 are provided in the segment. In place of the resilient material such as the plate spring and rubber, a fluid mechanism may be used as the buffer means.

The operation of the mandrel provided with the buffer means according to the present invention will now be described.

In the wedge type mandrel, the buffer means 4 fitted between the drum segments 1 and the core shaft 2, as shown in FIGS. 1 and 4, all have the same construction so that under a load larger than a predetermined value the block 43 is resiliently depressed and the holding surface is held lower than in other segments. Accordingly, when a predetermined load is applied to any one of the four segments constituting the winding drum, the resilient members 42 of the buffer means supporting said one segment are pressed against the reaction force thereto and only said one segment is displaced radially inwardly resulting to the position shown in FIG. 4 in which a portion of the cylindrical shaft constituted by the four segments is depressed by the thickness $t$ of the strip 6. In the present invention, it is necessary to make the restoring force $P_S$ of the mandrel smaller than the pressing force $P_W$ of wrapper rolls 7 disposed about the mandrel and larger than the winding force $P_M$ ($P_M < P_S < P_W$). The following relationship is maintained between the centrifugal force $P_E$ of the mandrel and the resilient restoring force P. Namely, $$P_M < P+P_E < P_W \text{ or } P_S$$

During coiling of a thick strip using the apparatus according to the present invention, the segment 1*a* corresponding to the leading end T of the strip is depressed more than other segments by the interposition of one additional layer of the coil between itself and the wrapper roll 7 as shown in FIG. 4 to thereby cause a step-like difference in coil thickness equal to the thickness $t$ of the strip between the winding surface of said segment 1*a* and those of adjacent segments particularly of the segment 1*b* forward of said segment 1*a* in the rotational direction. Accordingly, the resilient members 42 of the buffer means supporting the segment 1*a* are compressed by the pressing action of the wrapper rolls 7 against the reaction force thereof to thereby displace the segment 1*a* radially inwardly. As the result, the winding surface of the leading end T of the coil is somewhat depressed from the winding surface of the other portions to thereby prevent formation of any undue step-like difference in coil thickness in and after the second turn and to thus avoid occurrence of a top mark in the coil.

In the link type mandrel according to the present invention, the attachments for the links 105 interposed between the segments 101 and the core shaft 102 all have the same construction as shown in FIGS. 6 and 8. Upon application of a load larger than a predetermined value, one attachment end of the link 105 is depressed. Accordingly, as shown in FIG. 8, when a predetermined load is applied to any one 101*a* of the four segments constituting the winding drum, the resilient members 142 of the links supporting said one segment 101*a* are pressed against the reaction force thereof to thereby keep a portion of the drum constituted by the four segments depressed an amount equal to the thickness $t$ of the strip 6. In this case, the segment 101*a* corresponding to the position of the leading end T of the coil is pressed to provide for an additional thickness of a strip interposed between itself and the wrapper rolls 7 to thereby form a step-like difference in coil thickness corresponding to the thickness $t$ of the strip with respect to the winding surface of the adjacent segments particularly of the segment 101*b* forward thereof in the rotational direction. Accordingly, the buffer means 104 of the links supporting the segment 101*a* are compressed by the pressing action of the wrapper rolls 7 to thereby displace said segment 101*a* radially inwardy. As a result, the winding surface of the leading end T of the coil is somewhat depressed from the winding surface of the other portions to thereby prevent formation of any undue step-like difference in coil thickness in and after the second turn and to thus avoid occurrence of a top mark in the coil.

As described hereinabove, there must be the relationship expressed by the following formulas among the restoring force $P_S$ of the mandrel, the pressing force $P_W$ of the wrapper roll, the winding force $P_M$, the centrifugal force $P_E$ of the coiling shaft, and the resilient restoring force P:

$$P_M < P_S < P_W$$

$$P_M < P+P_E < P_W \text{ or } P_S$$

The mandrel according to the present invention can be used for coiling both relatively thick strip which is 6 mm or greater in thickness and relatively thin strip which is 6 mm or smaller in thickness. In coiling of the relatively thick strip, the range of reduction of the diameter of the drum is controlled by said buffer means, and in coiling of the relatively thin strip the range of increase of diameter of the drum is controlled by means to be described hereinunder since the buffer means are not necessary in this case, to thereby improve the coiling of the strip.

The mandrel according to the present invention is provided also with the means for preventing expansion of the diameter of the drum so as to keep said buffer means from functioning when so required.

Figure 9:
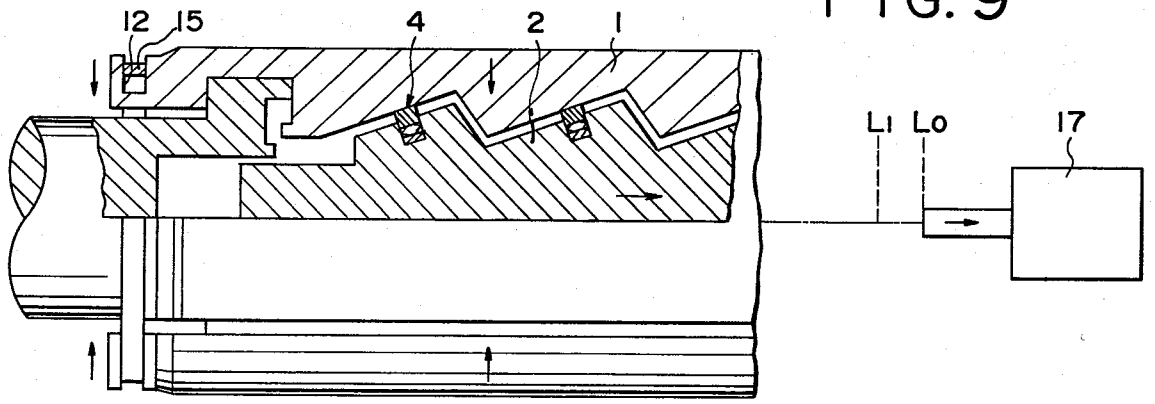
FIG. 9 is a view similar to FIG. 1 showing the mandrel partially improved so as to be suitable for coiling a relatively thin strip.
Figure 10:
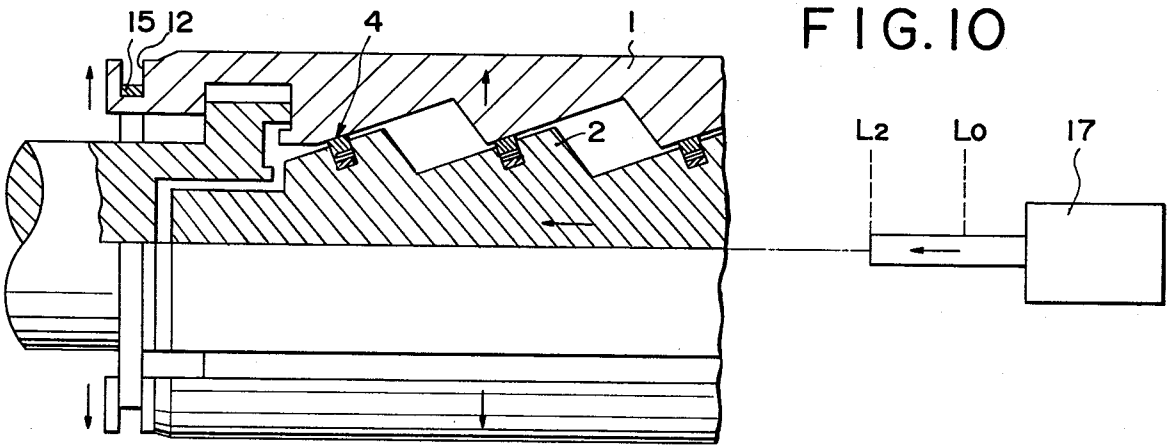
FIG. 10 is a view similar to FIG. 9 showing another mode of operation.

The drum diameter expansion preventing means will be described in fuller detail hereinunder taking the case of the wedge type mandrel as an example. As shown in FIGS. 9 and 10, at opposite ends of the drum constituted by the segments 1 are provided ring-shaped grooves or reduced steps 12 into which retainer rings 15 are removably fitted. Said retainer rings 15 are designed to have an inside diameter such as to prevent the segments 1 from expanding the drum diameter while the buffer means 4 are kept inoperable when the cylinder 17 for driving the core shaft is in the position to make the size of the drum the largest or nearly the largest (or alternatively when said cylinder is in the position to make the size of the drum the smallest or nearly the smallest). Further, the stroke of the piston rod in the cylinder is made in two steps and, accordingly, the standard outside diameter determined by the segments 1 is also reached in two steps so that the first part of the stroke $L_1$ having a reduceable margin of the buffer means 4 is used for coiling a relatively thick strip (FIG. 9) and the second part of the stroke $L_2$ limited by the diameter by the retainer ring 15 is used for coiling a relatively thin strip(FIG. 10). $L_0$ denotes the initial rod position.

Figure 11:
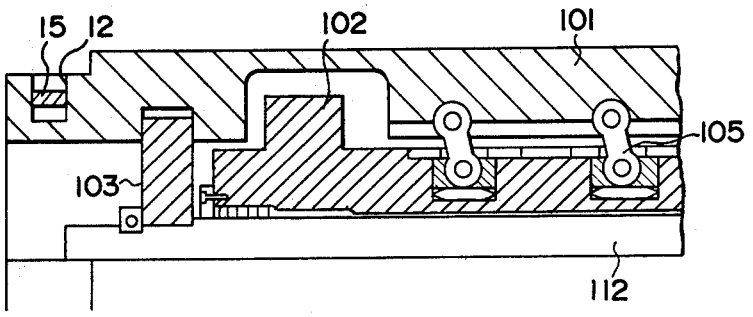
FIG. 11 is a view similar to FIG. 9 showing the mechanism thereof applied to a link type mandrel.

While the above embodiment has been described with reference only to the wedge type mandrel, it can be applied, of course, to the link type mandrel as shown in FIG. 11. The construction and operation are the same as those described hereinabove.

The present invention can be applied to a mandrel having a two-stage expandable collapsable cylinder. Namely, after a turn of the strip has been coiled the cylinder is shifted to expand the mandrel in two steps with the result that the resilient members function in the first step but do not function in the second step to thereby apply a suitable tension to the strip so as to improve the coil form.

According to the mandrel of the present invention, as described above, it is possible to coil a relatively thick strip without occurrence of top marks to thereby considerably increase the yield of products, particularly of thick spiral pipes.

With the relatively thick hot strip coiling mandrel, it is possible to precisely coil both relatively thick and thin strips without producing any defects to thereby improve the coil form and to considerably increase the quality of the products.

We claim:

1. A hot strip coiling mandrel having a mechanism for radially expanding and collapsing a drum comprised of a plurality of circumferentially equally divided segments engaged around a core shaft by moving the core shaft or the drum segments axially relative to each other, said mandrel being characterized by buffer means comprising contact blocks and resilient members supporting said blocks resiliently and provided between said core shaft and each of said segments and urging said segments radially outwardly of said mandrel.

2. A hot strip coiling mandrel of the wedge type comprising a core shaft having a plurality of circumferentially spaced lines of inclined saw-tooth faces thereon extending longitudinally of the shaft, and a plurality of circumferentially equally divided drum segments around said core shaft and each having on the inner surface thereof a line of longitudinally extending saw-tooth engaging faces complementary to and opposed to the inclined saw-tooth faces on the core shaft, a mechanism connected to said core shaft and said drum segments for radially expanding and collapsing the drum formed by said segments by relatively axially moving the core shaft and the segments, each of the inclined faces of one of said core shaft and said segments having at least one recess therein extending in a predetermined angular direction to said inclined faces and buffer means between said core shaft and each of said segments, each of said buffer means comprising a block means slidably fitted in a corresponding recess and a resilient member associated with said block means and urging said block toward the other of said core shaft and said segments for urging said segments radially outwardly of said mandrel.

3. A hot strip coiling mandrel as claimed in claim 2 in which said block means is a single block, and said resilient member is between said block and the bottom of said recess.

4. A hot strip coiling mandrel as set forth in claim 2 in which each said block means is two block pieces which are complementarily shaped and said resilient member is between said block pieces.

5. A hot strip coiling mandrel as set forth in claim 2 in which each said recess is perpendicular to the inclined face in which it is located.

6. A hot strip coiling mandrel as set forth in claim 2 in which each said recess is perpendicular to the axis of the mandrel.

7. A hot strip coiling mandrel as set forth in claim 2, further comprising a retainer ring mounted on the outer surface of the drum at each of the opposite ends thereof for preventing the drum from expanding in diameter during a coiling operation.

8. A hot strip coiling mandrel of the link type comprising a plurality of circumferentially equally divided drum segments, a core shaft disposed in the center of the space within the drum defined by said segments, a plurality of links connecting said segments and said core shaft with a predetermined distance therebetween, a mechanism connected to said core shaft and said drum segments for radially expanding and collapsing the drum defined by said segments by relatively axially moving said segments and said core shaft, one of said core shaft and said drum segments having a plurality of recesses therein where the links are connected thereto, and buffer means provided between said core shaft and each of said segments, each of said buffer means comprising a block slidable in a corresponding recess and to which an end of the corresponding link is pivotally attached, and a resilient member between the bottom surface of said recess and said block and urging said block toward the other of said core shaft and said segments for urging said segments radially outwardly of said mandrel.

9. A hot strip coiling mandrel as set forth in claim 8, further comprising a retainer ring mounted on the outer surface of the drum at each of the opposite ends thereof for preventing the drum from expanding in diameter during a coiling operation.

* * * * *